US006841936B2

(12) United States Patent
Keller et al.

(10) Patent No.: US 6,841,936 B2
(45) Date of Patent: Jan. 11, 2005

(54) FAST RECOVERY ELECTRON MULTIPLIER

(75) Inventors: Craig A. Keller, Fremont, CA (US); Fiona L. Plows, Palo Alto, CA (US)

(73) Assignee: Ciphergen Biosystems, Inc., Fremont, CA (US)

( * ) Notice: Subject to any disclaimer, the term of this patent is extended or adjusted under 35 U.S.C. 154(b) by 0 days.

(21) Appl. No.: 10/441,939

(22) Filed: May 19, 2003

(65) Prior Publication Data

US 2004/0232835 A1 Nov. 25, 2004

(51) Int. Cl.[7] ..... H01J 29/52; H01J 43/18

(52) U.S. Cl. ..... 313/533; 313/537; 315/46; 315/49; 315/63; 315/198; 315/199; 315/208; 315/339; 315/349; 250/207

(58) Field of Search ..... 313/103 R, 533, 313/105 R, 534, 103 CM, 105 CM, 537; 315/39.63, 46, 63, 121, 122, 134, 198, 199, 208, 245, 325, 339, 349, 383; 250/207

(56) References Cited

U.S. PATENT DOCUMENTS

| | | | | |
|---|---|---|---|---|
| 3,432,669 A | * | 3/1969 | Radke et al. | 250/207 |
| 4,825,066 A | * | 4/1989 | Nakamura et al. | 250/207 |
| 5,367,222 A | * | 11/1994 | Binkley | 315/12.1 |
| 5,401,951 A | * | 3/1995 | Butler et al. | 250/207 |
| 5,512,755 A | | 4/1996 | Vickers et al. | |
| 5,525,794 A | | 6/1996 | Gibbons | |
| 5,864,141 A | | 1/1999 | Majewski et al. | |
| 5,880,457 A | | 3/1999 | Tomiyama et al. | |

OTHER PUBLICATIONS

Weinberger et al., "Time–of–flight Mass Spectrometry" in *Encyclopedia of Analytical Chemistry*, Sections 7.2 and 7.3, pp. 24–27 (2000).

* cited by examiner

*Primary Examiner*—Ashok Patel
(74) *Attorney, Agent, or Firm*—Townsend and Townsend and Crew LLP

(57) ABSTRACT

An improved electron multiplier bias network that limits the response of the multiplier when the multiplier is faced with very large input signals, but then permits the multiplier to recover quickly following the large input signal. In one aspect, this invention provides an electron multiplier, having a cathode that emits electrons in response to receiving a particle, wherein the particle is one of a charged particle, a neutral particle, or a photon; an ordered chain of dynodes wherein each dynode receives electrons from a preceding dynode and emits a larger number of electrons to be received by the next dynode in the chain, wherein the first dynode of the ordered chain of dynodes receives electrons emitted by the cathode; an anode that collects the electrons emitted by the last dynode of the ordered chain of dynodes; a biasing system that biases each dynode of the ordered chain of dynodes to a specific potential; a set of charge reservoirs, wherein each charge reservoir of the set of charge reservoirs is connected with one of the dynodes of the ordered chain of dynodes; and an isolating element placed between one of the dynodes and its corresponding charge reservoir, where the isolating element is configured to control the response of the electron multiplier when the multiplier receives a large input signal, so as to permit the multiplier to enter into and exit from saturation in a controlled and rapid manner.

18 Claims, 5 Drawing Sheets

FAST RECOVERY ELECTRON MULTIPLIER

BACKGROUND OF THE INVENTION

The present invention relates to electron multipliers. More specifically, the present invention is related to electron multipliers used as detectors for time-of-flight mass spectrometry.

Electron multipliers are often utilized as detectors for time-of-flight mass spectrometry. There are two types of electron multipliers: discrete dynode electron multipliers and continuous dynode electron multipliers. Discrete dynode multipliers generally consist of a cathode; a series of dynodes, shaped plates or assemblies of plates; and an anode connected together by a chain of resistors. A high voltage is applied across the chain to create a potential difference between each pair of dynodes that drives secondary electrons down the dynode chain to the anode.

In an electron multiplier, an ion or other particle striking the cathode will produce secondary electrons that are accelerated to the first dynode. Upon striking the first dynode, these electrons generate another set of secondary electrons which are in turn accelerated to the second dynode, and so on through the multiplier. When the potential difference between a pair of dynodes is large enough each electron striking a dynode will, on average, produce more than one secondary electron. The average number of secondary electrons per primary electron produced at a particular dynode is the gain of that stage of the electron multiplier. The gain of the entire electron multiplier is the product of the gain at every stage from the cathode to the last dynode. Increasing the voltage applied to the electron multiplier typically increases the voltage between dynodes, increasing the gain of each stage, thereby increasing the gain of the entire multiplier. Typical electron multipliers have 10–30 stages, operate with an applied voltage of 1000–5000V, and are capable of producing gains larger than $10^5$.

Discrete dynode multipliers are commonly used for the detection of particles such as photons, ions or neutral molecules. Because of the very large gains possible with electron multipliers it is possible to detect, with some efficiency, the arrival of single particles that have enough energy to cause the generation of secondary electrons at the conversion surface of the electron multiplier. At the same time, it is possible for an electron multiplier to behave linearly with incident signals corresponding to over a thousand particles arriving simultaneously. In addition to this instantaneous dynamic range, electron multipliers typically have response times less than a few nanoseconds and noise levels corresponding to less than a few incident particles per minute. Together these characteristics make electron multipliers useful for measuring particle fluxes from a few particles per minute to hundreds of particles per nanosecond.

FIG. 1 is a typical wiring diagram 100 for a simple electron multiplier. An external voltage source needs to be connected to the electron multiplier in such a way that the cathode 102 and each succeeding multiplier stage are correctly biased with respect to one another. Because electrons must be accelerated through the electron multiplier, the first dynode 104 is held at a potential higher than the cathode 102 and each succeeding dynode 106–116 is held at a potential higher than the preceding dynode. For efficient operation, the potentials applied across the first few stages of the electron multiplier are often several times the potentials applied to the stages in the middle of the multiplier. The interstage voltages of an electron multiplier may be supplied by individual voltage sources such as batteries or power supplies, or, as is more common, by a small number of voltage sources 122 and a network of resistors that forms a multi-stage voltage divider 120.

Because of the multiplying function of an electron multiplier, each dynode will source more electrons than the preceding dynode. Thus, the voltage sources near the anode 118 must supply more current than those earlier in the chain. Because the ion fluxes measured with electron multipliers are generally pulsed, the extra current for the dynodes near the anode 118 can be supplied with capacitors 124. These capacitors reduce the change in voltage between dynodes caused by the loss of electrons during multiplication (amplification) of an input signal and then recharge through the bias network 120 during periods where there is little or no input signal.

As long as the output of the multiplier is in fixed proportion to the input signal, the electron multiplier is said to be operating linearly. For input signals near the upper end of the linear range of an electron multiplier, the electron multiplier can only maintain the large output signal until the loss of electrons from the dynodes and their associated capacitors causes the voltage on the dynodes to change significantly; this, in turn, causes the gain of the multiplier to change. At this point, the electron multiplier is said to be entering saturation. If the large input signal continues, the gain of the electron multiplier will continue to decrease until the output signal is small enough that it can be supplied continuously. At this point, the electron multiplier can be said to be completely saturated.

To recover from a saturating event, the capacitance associated with the dynodes of the electron multiplier must recharge. This recharge typically occurs through the resistors of the bias network. Since the bias network of electron multipliers generally have impedances of about 107 ohms and the dynodes have capacitances near $10^{-11}$ F the recharging of the dynode capacitance occurs with a characteristic time of approximately $10^{-4}$ s. Extra capacitance added as a charge reservoir can dramatically increase this time. For example, 10 nF of extra capacitance will increase the characteristic recharge time to 0.1 s. These are very long times when compared to the typical few ns width of the pulses produced by the electron multiplier. During this recharging time the multiplier does not have the gain or linearity of a multiplier with a fully charged dynode chain.

The long time required to recover from charge depletion induced non-linearity limits the utility of electron multipliers in situations where small signals-of-interest follow large signals that can drive the multiplier into a charge depleted state. Matrix assisted laser desorption/ionization time of flight mass spectrometry ("MALDI-TOFMS") is such an application. In MALDI-TOFMS, the ions-of-interest follow, in time, a large matrix signal that can drive the electron multiplier into charge depletion and prevent the efficient detection of ions for a substantial amount of time after the matrix signal has ended.

One way of addressing the charge depletion is to design an electron multiplier with more capacitance in the dynode chain. An example of an implementation of this solution was presented at the 2002 meeting of American Society for Mass Spectrometry ("ASMS") in Orlando Fla. (Kevin L. Hunter, Dick Stresau, Wayne Sheils, "Influence of capacitance networks on the pulse dynamic range and recovery time of time-of-flight detectors"). The extra capacitance added to each dynode allowed the electron multiplier to source much larger output currents before entering charge depletion. FIG.

2 shows the circuit diagram 200 of an electron multiplier modified to have capacitors 226–244 connected with each of the dynodes in the dynode chain.

The additional capacitance defers the onset of charge depletion, but, since the detector can only source a fixed amount of charge over its lifetime, the additional capacitance and the larger possible output current can result in a substantially shortened detector lifetime. Initial results indicate that the lifetime of such a detector can be as short as several days when used for MALDI-TOFMS. Another disadvantage of the additional capacitance is a substantially increased recovery time for the electron multiplier after saturation.

There is therefore a need for an improved electron multiplier that does not suffer from the above-mentioned shortcomings.

BRIEF SUMMARY OF THE INVENTION

The present invention is directed to an improved electron multiplier bias network that limits the response of the multiplier when the multiplier is faced with very large input signals, and also permits the multiplier to recover in a very short time following the large input signal.

In one aspect, this invention provides an electron multiplier, including: a cathode that emits electrons in response to receiving a particle, wherein the particle is one of a charged particle, a neutral particle, or a photon; an ordered chain of dynodes wherein each dynode receives electrons from a preceding dynode and emits a larger number of electrons to be received by the next dynode in the chain, wherein the first dynode of the ordered chain of dynodes receives electrons emitted by the cathode; an anode that collects the electrons emitted by the last dynode of the ordered chain of dynodes; a biasing system that biases each dynode of the ordered chain of dynodes to a specific potential; a set of charge reservoirs, wherein each charge reservoir of the set of charge reservoirs is connected with one of the dynodes of the ordered chain of dynodes; and an isolating element placed between one of the dynodes and its corresponding charge reservoir, where the isolating element is configured to control the response of the electron multiplier when the multiplier receives a large input signal, so as to permit the multiplier to enter into and exit from saturation in a controlled and rapid manner.

In one embodiment, the biasing system biases each dynode of the ordered chain of dynodes to a potential higher than the potential of the preceding dynode.

In one embodiment, the isolating element is configured to enable a more rapid recovery of the potential of a dynode following a saturating event, than in an electron multiplier not having the isolating element.

In one embodiment, the dynodes, the charge reservoirs and the isolating element are configured to permit the multiplier to respond essentially linearly to the second of two ion producing events occurring within a short time period, where, in an electron multiplier without the isolating element, the first ion producing event would drive the electron multiplier into saturation causing distortion or missing of the second ion producing event.

In one embodiment, the isolating element is one of a set of isolating elements, each one of the set of isolating elements placed between one of the dynodes and its corresponding charge reservoir.

In one embodiment, the isolating element is a resistor. In one embodiment, the resistance value of the isolating element is smaller than the effective resistance of the biasing system.

In one embodiment, the isolating element is configured to enable the multiplier to recover from a saturating event faster than an electron multiplier without such an isolating element.

In one embodiment, the charge reservoir are capacitors, electrochemical cells or a power supplies.

In one embodiment, the isolating element is configured to limit the amount of charge that the multiplier can output in response to a large signal.

In one aspect, the invention provides a method for operating an electron multiplier, including: providing an electron multiplier where the electron multiplier comprises a cathode that emits electrons in response to receiving a particle, wherein the particle is one of a charged particle, a neutral particle, or a photon; an ordered chain of dynodes wherein each dynode receives electrons from the preceding dynode and when the energy of the incident electrons is large enough emits a larger number of electrons to be received by the next dynode in the chain, wherein the first dynode of the ordered chain of dynodes receives electrons emitted from the cathode; an anode that collects the electrons emitted by the last dynode of the ordered chain of dynodes; a biasing system that biases each dynode of the ordered chain of dynodes to a particular potential; a set of charge reservoirs, wherein each charge reservoir of the set of charge reservoirs is connected with one of the dynodes of the ordered chain of dynodes; and an isolating element placed between one of the dynodes and its corresponding charge reservoir, so as to control the response of the electron multiplier when the multiplier receives a large input signal, so as to permit the multiplier to enter into and exit from saturation in a controlled manner.

In one aspect, the method of the invention includes using the isolating element for limiting the amount of current that can be drawn from the charge reservoir associated therewith, thereby causing the electron multiplier to enter saturation slowly.

In another aspect, the method of the invention includes using the isolating element for minimizing the total amount of charge removed from the charge reservoir associated therewith and the dynodes associated therewith, thereby reducing the time required to recover from saturation.

In another aspect, the method of the invention includes configuring the dynodes, the charge reservoirs and the isolating element to allow the electron multiplier to respond essentially linearly to the second of two signal producing events occurring within a short period of time, where in an electron multiplier without the isolating element, the first signal producing event would drive the electron multiplier into saturation causing distortion or missing of the second signal producing event.

In another aspect, the method of the invention includes selecting a resistance value for the isolating element that is smaller than the effective resistance of the biasing system.

For a further understanding of the nature and advantages of the invention, reference should be made to the following description taken in conjunction with the accompanying drawings.

DETAILED DESCRIPTION OF THE INVENTION

Embodiments of the present invention are directed towards modifications of an electron multiplier's bias network that limit the response of the multiplier when the multiplier is faced with an input signal larger than the upper limit of the range of interest, and also permit the electron multiplier to recover fully and rapidly when the large input signal ends. Rapid recovery allows the detector to be used to measure small signals that occur shortly after the out-of-range signal ends. Limiting the response of the electron multiplier to out-of-range input signals has the added benefit of increasing the lifetime of the detector by decreasing the gain of the multiplier during out-of-range signals. The following terms are used herein, namely: in-range signal; out-of-range signal; and saturating signal to describe different ranges of input signals. An in-range signal is one that is within the linear range of the electron multiplier. An out-of-range signal is a signal that is larger than the largest signal in the signal range of interest; with the electron multiplier modifications described here these signals will experience limiting, that is, they will be passed through the electron multiplier with reduced gain. A saturating signal is an input signal large enough to cause an electron multiplier without the modifications described here to enter into saturation. Saturation is the state of the multiplier when, due to removal of charge from the multiplier's dynodes and charge reservoirs, a large signal causes the response of the multiplier to become substantially non-linear.

Figure 1:
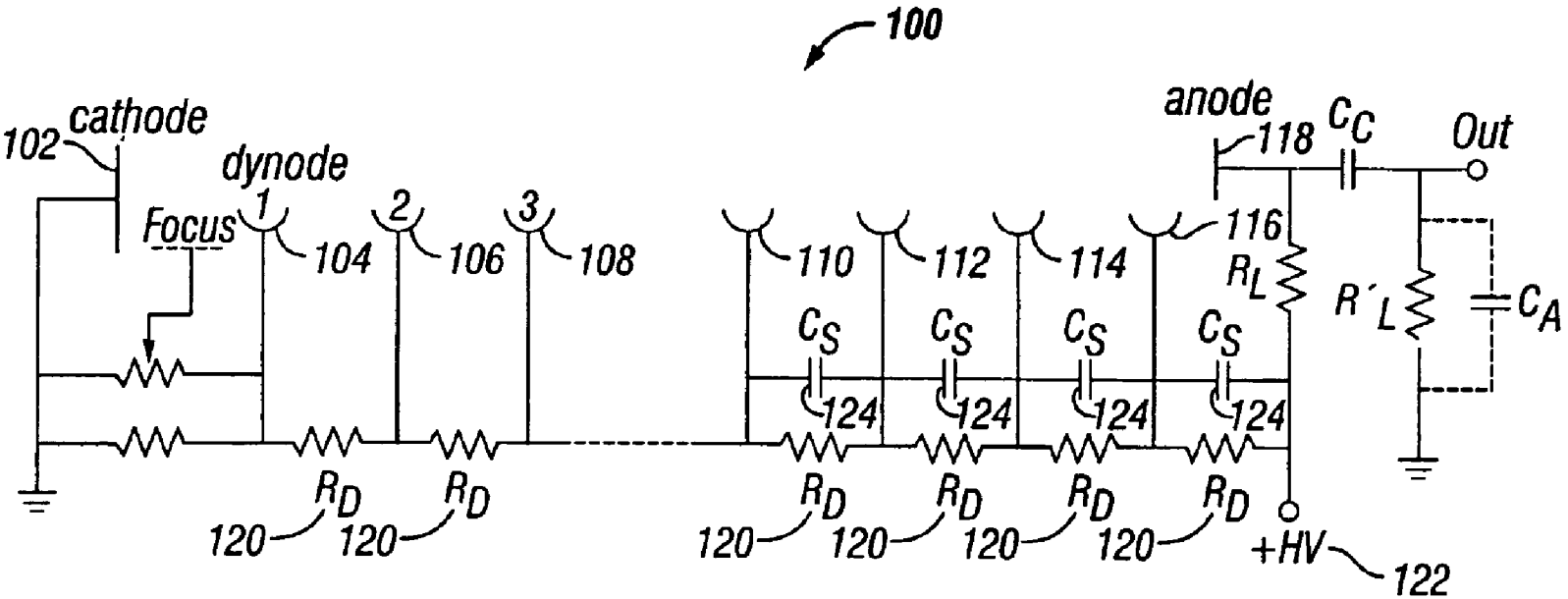
FIG. 1 (Prior Art)
FIG. 1 is a typical wiring diagram for a basic electron multiplier.
Figure 2:
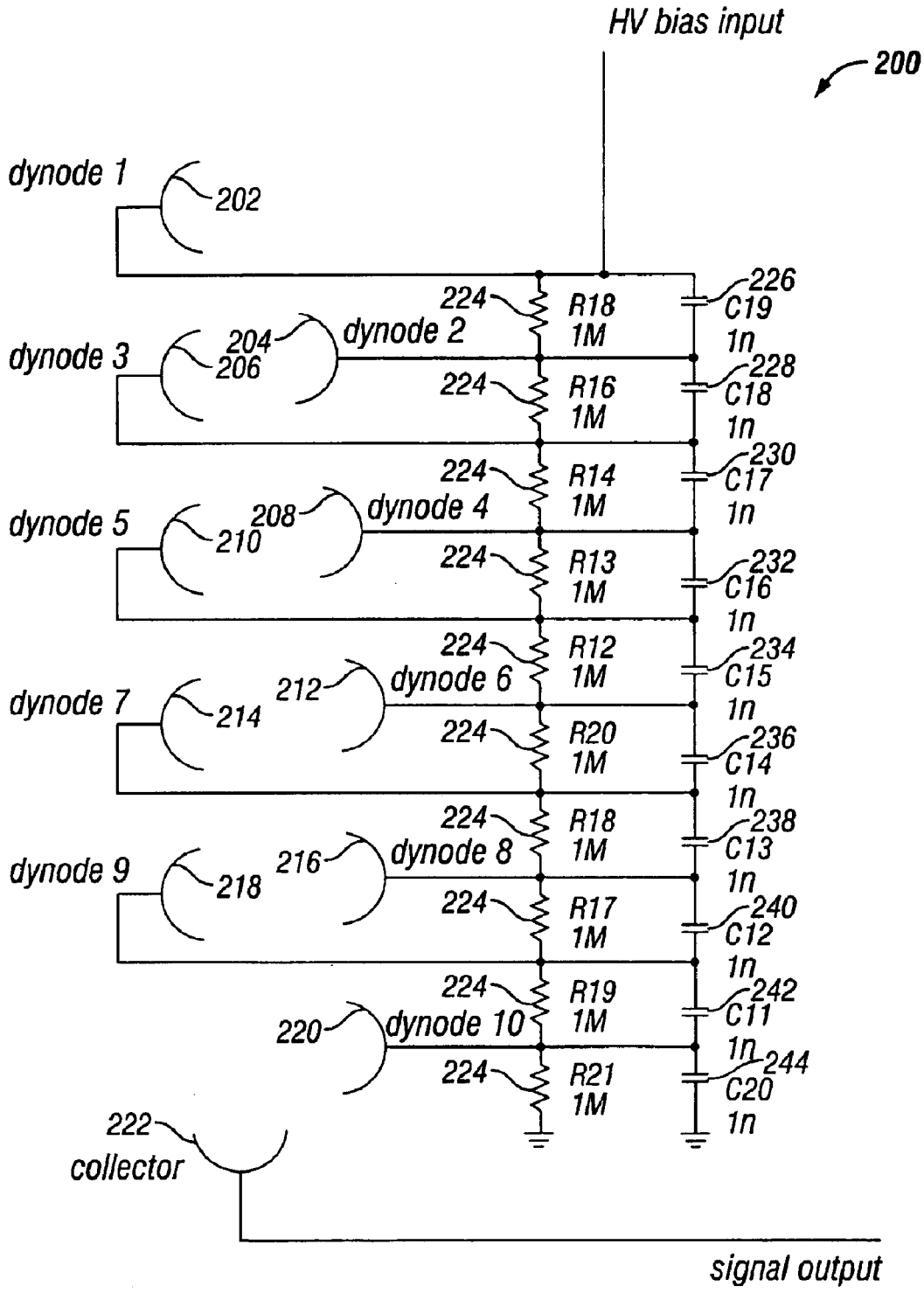
FIG. 2 (Prior Art)
FIG. 2 is a circuit diagram of an electron multiplier modified to have a capacitor connected with each of the dynodes in the dynode chain.
Figure 3:
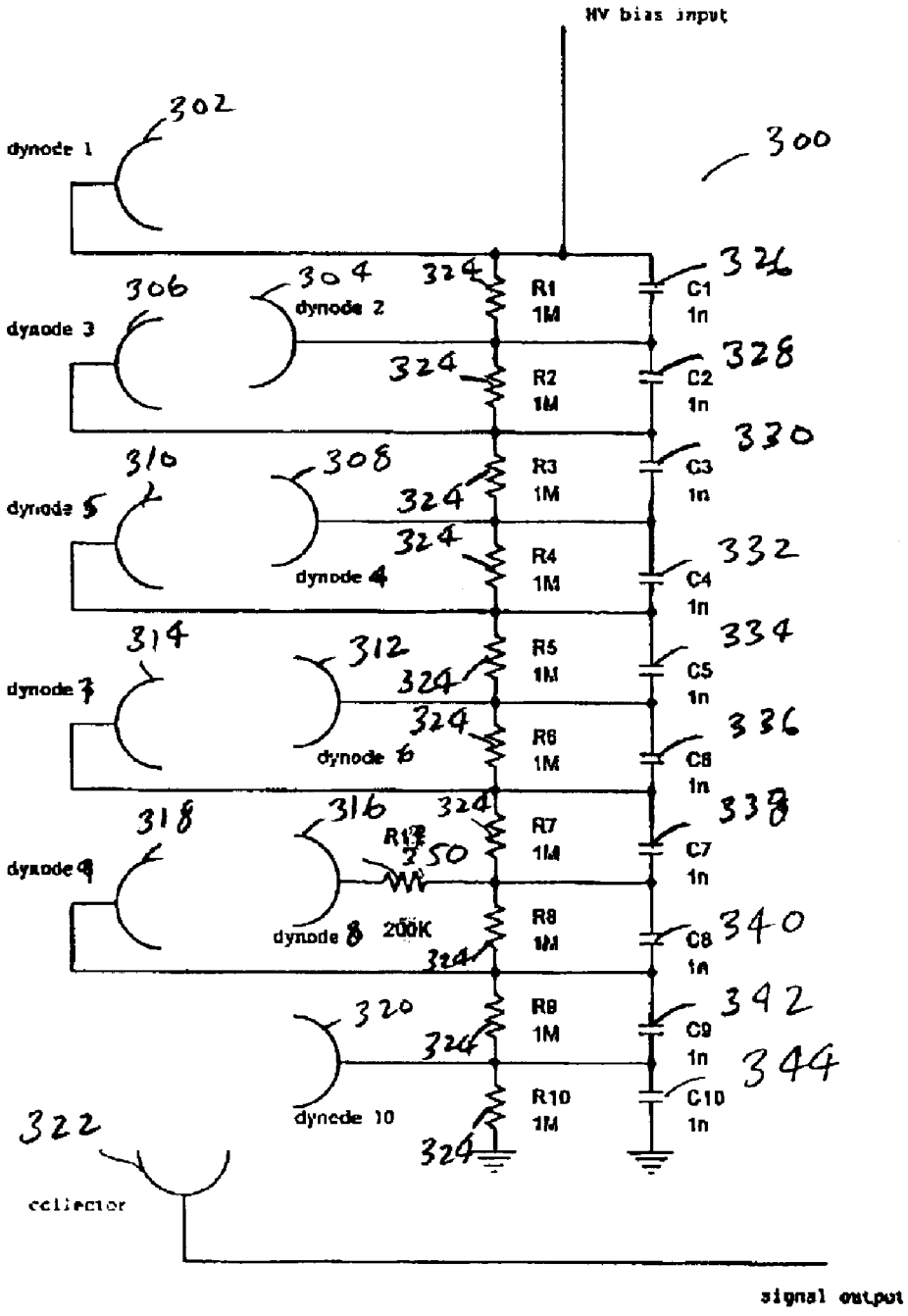
FIG. 3 is a circuit diagram of an electron modifier modified in accordance with embodiments of the present invention.

FIG. 3 shows the circuit diagram 300 of an electron multiplier modified in accordance with the embodiments of the present invention. This figure shows an ordered chain of 10 dynodes 302–320, where under normal operation each dynode receives electrons from a preceding dynode and emits a larger number of electrons to be received by a next dynode in the chain; an anode 322 that collects the electrons emitted by the last dynode in the chain of dynodes; a biasing system formed with a resistive voltage divider 324 that biases each dynode to a potential higher than the potential of the preceding dynode; and charge reservoirs 326–344 connected to each of the dynodes to supply the current lost from the dynode during the detection event. In addition, FIG. 3 shows an isolating element 350 connected in-between dynode 316 and its corresponding charge reservoir 340. For description purposes, the isolating element 350 is referred to as the recovery control element and the dynode 316 connected to the isolating element 350 is referred to as the recovery control dynode 316. A consequence of an isolating element between the recovery control dynode and its charge reservoir is that it separates or isolates the capacitance of the dynode from the capacitance of its charge reservoir. In one embodiment, the recovery control element is a resistor.

One embodiment of this circuit has the following component values: resistors (324) 1 MΩ, capacitors (326–340) 1 nF, capacitor (342) 3.3 nF, capacitor (344) 10 nF, and the recovery control element (350) 200 kΩ. These values are chosen based on the expected values of the input signal as well as the desired output from the detector. Aspects of the characteristics of these component values include: 1) the resistance of the recovery control element (350) is substantially smaller than the resistance of the bias network seen by the recovery control element, and 2) the capacitance of the charge reservoir for the charge reservoir associated with the recovery control dynode is much larger than the intrinsic capacitance of the recovery control dynode plus any capacitance connected directly to the recovery control dynode. While these characteristics are used herein, those possessing the requisite skills in the art of detecting particles using electron multipliers will realize that other values of components may also be used. In an alternate embodiment, the recovery control element is a variable resistor. Yet alternately, the recovery control element is a device or a circuit having resistances and capacitances such that the recovery control element has an impedance value and can be tuned to have a particular response. Accordingly, under certain conditions, with the recovery control element or device or circuit in place, the detector is enabled to limit the depletion of a charge from a charge reservoir while drawing charge from the recovery control dynode and thus allow the detector to recover faster. Using an impedance device or circuit as the recovery control element as an isolating element enables the tuning of the circuit and the detector to be frequency dependent.

This bias network causes the response of the electron multiplier to vary in a controlled manner as a function of the level of the input signal. For convenience, the behavior of the electron multiplier in accordance with the embodiments of the present invention is divided into three regimes that correspond to the input signal levels defined above, namely: in-range signal; out-of-range signal; and saturating signal.

For in-range signals, the potentials of the dynodes and their associated capacitors are determined by the resistive voltage divider. These signals are not large enough to cause charge depletion of the recovery control dynode nor to create a significant voltage drop across the recovery control element nor to cause significant changes of the potentials of the other dynodes due to charge depletion of their charge reservoirs. Thus, the gain of the electron multiplier is unperturbed by the applied signal and it behaves in a linear manner similarly as it would without the recovery control element.

For out-of-range signals, enough charge is removed from the relatively small capacitance of the recovery control dynode to substantially change its potential. A substantial change in potential is a change in potential that can result in a measurable change in the operation of the detector. Because the recovery control element provides some isolation between the recovery control dynode and its charge reservoir, the potential of the recovery control dynode is not directly stabilized by the charge reservoir. Instead, the recovery control dynode recharges in a characteristic time determined by the resistance, $R_{rce}$, of the recovery control element and the capacitance, $C_{rcd}$, of the recovery control dynode, $\tau=R_{rce}\,C_{rcd}$. Thus, brief out-of-range signals drive the electron multiplier into a state where its gain is reduced, but from which it can recover in the characteristic time $\tau$. The capacitance of the charge reservoir for the recovery control dynode, $C_{rccr}$, determines a second characteristic time, $\tau=R_{rce}C_{rccr}$, that determines the total duration of out-of-range signal that can be handled without the electron multiplier going into saturation. For the component values given above and a recovery control dynode capacitance of 5 pF, the characteristic recharge time, $\tau$, is 1 $\mu$s. This is much faster than the typical time to recover from saturation ($10^{-4}$ to 0.1 s) of an electron multiplier without the recovery control element.

For saturating signals, the recovery control element limits the amount of current that can be drawn from the charge reservoir of the recovery control dynode thereby causing the electron multiplier to enter saturation slowly. This reduces the total charge output by the multiplier in response to saturating signals thereby extending the operational lifetime of the multiplier. It also minimizes the total amount of charge removed from the charge reservoir of the recovery control dynode and the dynodes following the recovery control dynode, and as a consequence, reduces the time required to recover from saturation. Once substantial depletion of the charge stored in the charge reservoirs of any of the dynodes occurs, the recovery time of a multiplier with the recovery control element is similar to an equally depleted multiplier without the recovery control element. One of the advantages of a properly located recovery control element is that it minimizes the depletion of the charge reservoirs.

Because the capacitance directly associated with the dynode, the resistance of the recovery control element, and the capacitance of the charge reservoir for the recovery control dynode can all be varied by design, the recovery time and signal capacity can be designed to match the characteristics of the input signal. In such a design, a few of the considerations are:

1) a smaller resistance or impedance for the recovery control element will provide faster recovery.
2) a larger resistance or impedance for the recovery control element will allow longer periods of out-of-range signal before the multiplier is driven into saturation, and lower peak output for a continuous out-of-range signal.
3) a smaller capacitance at the recovery control dynode will cause the electron multiplier to limit at lower signal levels and provide faster recovery.
4) associating the recovery control element with a dynode closer to the end of the dynode chain will, assuming similar dynode capacitances, cause the limiting to occur at lower signal levels, but provide protection to fewer dynodes.

As is described above, the isolating element is placed between one charge reservoir and one dynode at the later stages of the dynode chain. Alternately, the isolating element may be placed between any dynode and its corresponding charge reservoir. Yet alternately, more than one isolating element may be used in the bias network, where each such isolating element is placed between a dynode and its charge reservoir. If the isolating element is placed earlier in the chain, then the limiting occurs at a higher signal level, and when the isolating element is placed later in the chain, then the limiting occurs at a smaller signal level, where earlier in the chain means nearer to the first dynode and later in the chain means nearer to the anode.

One advantage of the embodiments of the present invention is the ability of the multiplier to handle out-of-range signals without substantially depleting the charge provided by the charge reservoirs. The limiting behavior of the modified multiplier is caused by depletion of the charge stored on the native capacitance (other capacitance can be added if appropriate) of the recovery control dynodes and does not involve the charge stored on the capacitor chain. Thus, since the charge on the capacitor chain is not depleted by out-of-range signals, it is available for recharging the recovery control dynodes. A consequence of this is that the multiplier in accordance with the embodiments of the present invention shows unattenuated response for small signals that follow signals large enough to drive a multiplier without an isolating element into saturation. Such events are common in MALDI-TOFMS where the low mass energy absorbing molecules (commonly called matrix molecules) used to desorb the higher mass molecules of interest arrive at the detector before and often in far greater number than the molecules of interest. For example, in a 0.75 meter long TOFMS using 20 kV acceleration potential, a molecule of interest, glycoprotein immunoglobulin G ("IgG"), arrives at the electron multiplier used as a detector 164 $\mu$s after a much larger matrix signal.

Figure 4:
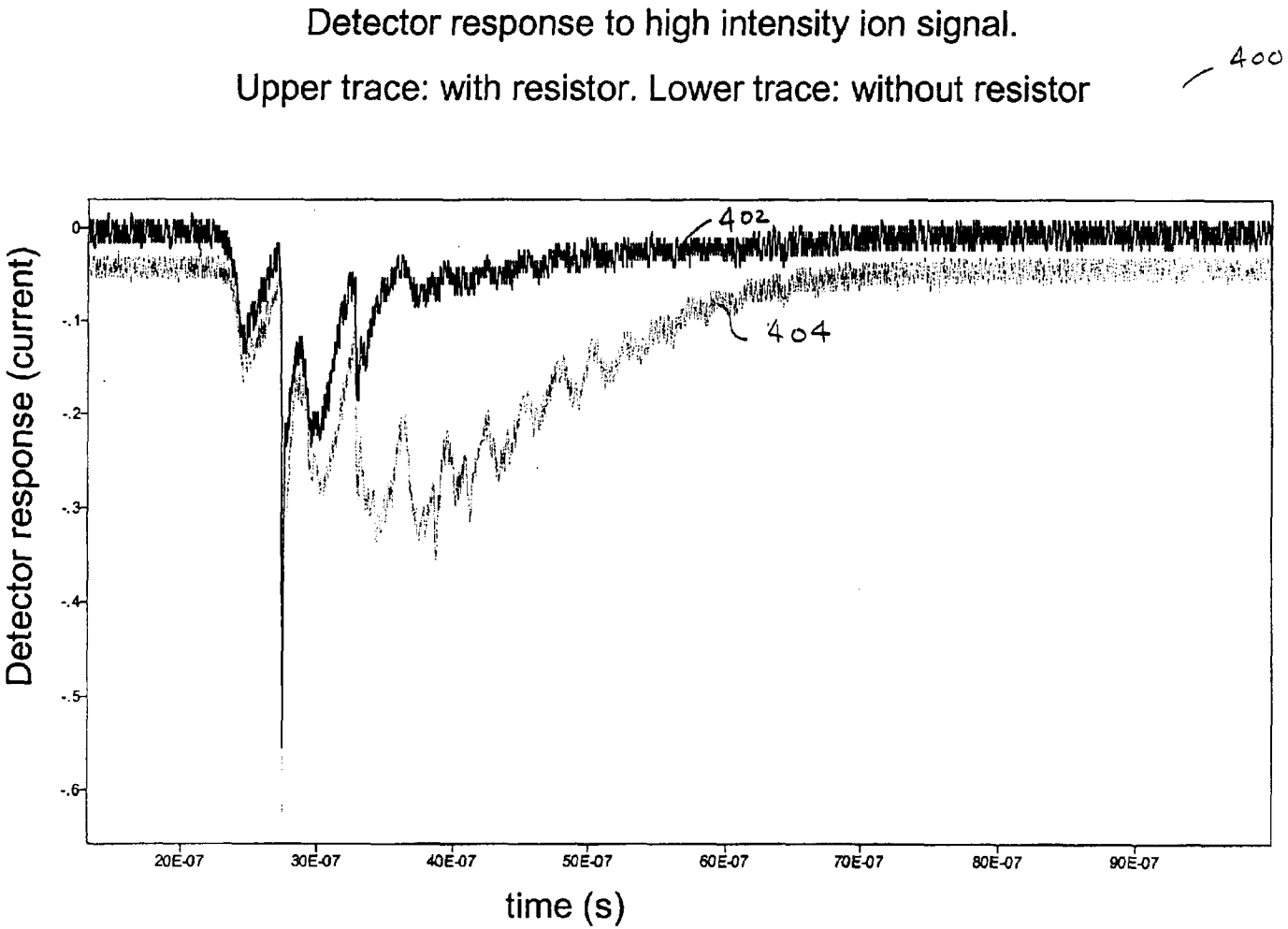
FIG. 4 is a graph showing the comparative responses of two electron multipliers to a high intensity ion signal, where only one of the two has an isolating element in accordance with embodiments of the present invention. Note that the baseline of trace (404) has been shifted down relative to trace (402).

FIG. 4 is a graph 400 showing the response to a high intensity ion signal of a single electron multiplier with and without an isolating element in accordance with embodiments of the present invention. The input signal to the detector is a high intensity pulse of ions, beginning at approximately 23E-07 seconds on the plot, large enough to drive the detector into saturation when it does not have an isolating element. The output signal of the detector, a negative current, is plotted versus time. The upper trace 402 shows the response of the detector with an isolating element and the lower trace 404 shows the response of a detector without an isolating element. As can be seen in FIG. 4, the two traces are essentially identical until approximately 30E-07 seconds on the plot, when the isolating element greatly reduces the response of the detector with the isolating element (trace 402). This plot shows that the isolating element provides substantial limiting of the integrated output current while it does not affect the initial response of the detector.

Figure 5:
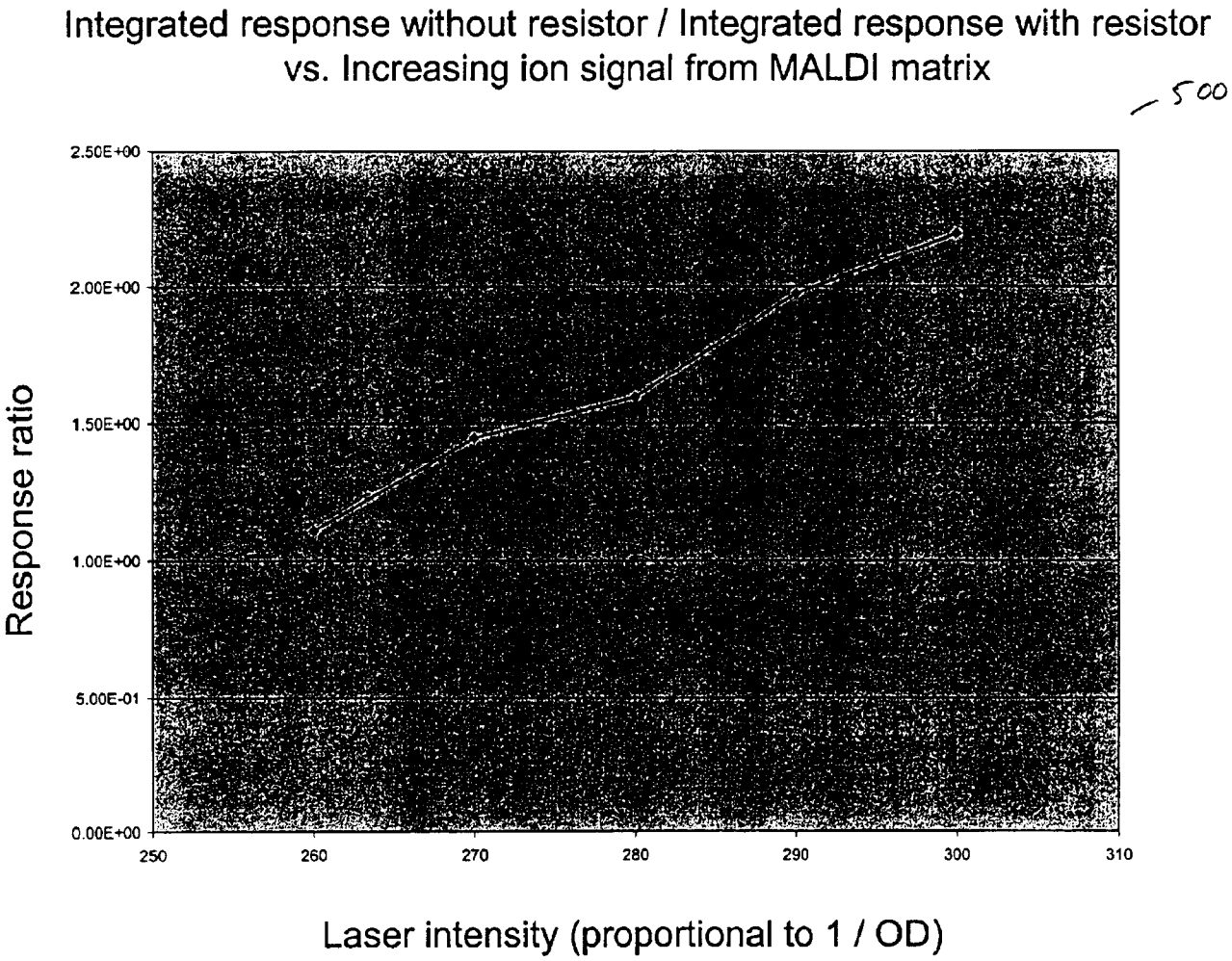
FIG. 5 is graph showing the ratio of integrated currents supplied by a detector having an isolating element in accordance with embodiments of the present invention to that of a detector without such an isolating element.

FIG. 5 is a graph 500 showing, as a function of the intensity of a laser used for desorbing ions in a MALDI-TOFMS, the ratio of integrated currents supplied by a detector without an isolating element in accordance with embodiments of the present invention to that of the same detector with such an isolating element. This figure demonstrates that as the ion signal into the detector increases, the effect of the isolating element becomes more pronounced. Furthermore, while not shown, below an intensity of approximately 250 on the laser intensity scale, the response of two detectors is identical.

The embodiments of the present invention include a variety of alternate circuit configurations. As is described above, the isolating element is placed between a particular charge reservoir and a particular dynode at the later stages of the dynode chain. Alternately, an isolating element may be placed between any dynode and its corresponding charge reservoir. For dynodes of equal capacitance, if an isolating element is associated with a dynode closer to the cathode, then the limiting occurs at a higher signal level, whereas, if the isolating element is associated with a dynode closer to the anode, then the limiting occurs at a lower signal level. Yet alternately, more than one isolating element may be used in the bias network, where each such isolating element is placed between a dynode and its charge reservoir. While the basic characteristics of an electron multiplier so modified will be similar to a multiplier with a single isolating element, several isolating elements permit the design of much more complicated dynamic characteristics. These characteristics can be matched to a particular application or designed to produce a particular functional response from the electron multiplier.

Furthermore, as described above, a capacitor is used as a charge reservoir for each dynode. Alternately, some of the dynodes can be left without charge reservoirs. Yet, alternately, capacitors can be added to the dynode side of the isolating elements to increase the capacitance of one or more of the recovery control dynodes. This arrangement increases the signal level where the limiting behavior begins, and also tends to increase the recovery time following a large input signal. Alternately, batteries or power supplies can be used for one or more of the charge reservoirs.

A different method for achieving signal roll-off is by way of a blanking circuit. In a blanking circuit configuration, the interstage gain of the dynodes, preferably those dynodes at or near the initial stages is selectively lowered or even reduced to essentially zero to effectively take the detector out of operation. Using a blanking circuit to reduce the dynode voltage to impede electrons from getting attracted to subsequent dynodes limits the multiplier's response to a large input signal for an initial time period, after which the blanking is turned off and the detector is then able to normally detect particles. The use of a blanking circuit is a known practice for detectors subject to saturation, especially channel plates. As it relates to TOF-MS, blanking can be used as a way to improve TOF-MS performance and spectra. In a TOF-MS implementation, blanking can be implemented by applying a pulse or switched voltage, for example, by way of a capacitively coupled pulse to a dynode in a discrete electron multipliers, rather than a changing DC potential.

Electron multipliers in accordance with embodiments of the present invention have many advantages over existing electron multipliers. An electron multiplier in accordance with the embodiments of the present invention is able to provide rapid recovery of full small signal sensitivity after the arrival of a large signal and also able to extend the lifetime of an electron multiplier by reducing the charge supplied by the detector in response to out-of-range or saturating signals. As a consequence, the embodiments of the present invention enable an electron multiplier to function quantitatively in an environment where the dynamic range of the signals exceeds the in-range capacity of the electron multiplier.

Accordingly, as will be understood by those of skill in the art, the present invention which is related to an improved electron multiplier having a large dynamic range, may be embodied in other specific forms without departing from the essential characteristics thereof. For example, more than one isolating element may be utilized in the circuit to dynamically isolate a dynode from its charge reservoir. In addition, the circuits may be modified by using elements of varying sizes and specifications, in order to tune the circuit for different possible dynamic ranges and/or charge limits and/or recovery periods. These circuit modifications and others may be used to tune the circuit for different possible dynamic ranges and/or charge limits and/or recovery periods. Accordingly, the foregoing disclosure is intended to be illustrative, but not limiting, of the ranges and scopes of the invention, which is set forth in the following claims.

What is claimed is:

1. An electron multiplier, comprising:

a cathode that emits electrons in response to receiving a particle, wherein the particle is one of a charged particle, a neutral particle, or a photon;

an ordered chain of dynodes wherein each dynode receives electrons from the preceding dynode and when the energy of the incident electrons is large enough emits a larger number of electrons to be received by the next dynode in the chain, wherein the first dynode of said ordered chain of dynodes receives electrons emitted from said cathode;

an anode that collects the electrons emitted by the last dynode of said ordered chain of dynodes;

a biasing system that biases each dynode of said ordered chain of dynodes to a particular potential;

a set of charge reservoirs, wherein each charge reservoir of said set of charge reservoirs is connected with one of said dynodes of said ordered chain of dynodes; and an isolating element placed between one of said dynodes and its corresponding charge reservoir.

2. The electron multiplier of claim 1 wherein said biasing system biases each dynode of said ordered chain of dynodes to a potential higher than the potential of the preceding dynode.

3. The electron multiplier of claim 1 wherein said isolating element is configured to enable a more rapid recovery of the potential of a dynode following a saturating event, than in an electron multiplier not having said isolating element.

4. The electron multiplier of claim 1 wherein said dynodes, said charge reservoirs and said isolating element are configured to allow the electron multiplier to respond essentially linearly to the second of two signal producing events occurring within a short period of time, where in an electron multiplier without the isolating element, the first signal producing event would drive the electron multiplier into saturation causing distortion or missing of the second signal producing event.

5. The electron multiplier of claim 1 wherein said isolating element is one of a set of isolating elements, each one of said set of isolating elements placed between one of said dynodes and its corresponding charge reservoir.

6. The electron multiplier of claim 1 wherein said isolating element is a resistor.

7. The electron multiplier of claim 6 wherein the resistance value of said isolating element is smaller than the effective resistance of said biasing system.

8. The electron multiplier of claim 1 wherein said isolating element is configured to enable said multiplier to recover from a saturating event faster than an electron multiplier without said isolating element.

9. The electron multiplier of claim 1 wherein one or more of said charge reservoirs comprises a capacitor.

10. The electron multiplier of claim 1 wherein one or more of said charge reservoirs comprises an electrochemical cell.

11. The electron multiplier of claim 1 wherein one or more of said charge reservoirs comprises a power supply.

12. The electron multiplier of claim 1 wherein said isolating element is configured to limit the amount of charge that the multiplier can output in response to a large signal.

13. A method for operating an electron multiplier, comprising:

providing an electron multiplier where the electron multiplier comprises a cathode that emits electrons in response to receiving a particle, wherein the particle is one of a charged particle, a neutral particle, or a photon;

an ordered chain of dynodes wherein each dynode receives electrons from the preceding dynode and when the energy of the incident electrons is large enough emits a larger number of electrons to be received by the next dynode in the chain, wherein the first dynode of said ordered chain of dynodes receives electrons emitted from said cathode;

an anode that collects the electrons emitted by the last dynode of said ordered chain of dynodes;

a biasing system that biases each dynode of said ordered chain of dynodes to a particular potential;

a set of charge reservoirs, wherein ea ch charge reservoir of said set of charge reservoirs is connected with one of said dynodes of said ordered chain of dynodes;

an isolating element placed bet between one of said dynodes and its corresponding charge reservoir; and controlling the response of the electron multiplier using said isolating element when the multiplier receives a large input signal, so as to permit the multiplier to enter into and exit from saturation in a controlled manner.

14. The method of claim 13 comprising using the isolating element for limiting the amount of current that can be drawn from the char ge reservoir associated therewith, thereby causing the electron multiplier to enter saturation slowly.

15. The method of claim 13 comprising using the isolating element for minimizing the total amount of charge removed from the charge reservoir associated therewith and the dynodes associated therewith, thereby reducing the time required to recover from saturation.

16. The method of claim 13 comprising using the isolating element for limiting the amount of current that can be drawn from the charge reservoir associated therewith, thereby causing the electron multiplier to enter saturation slowly, and using the isolating element for minimizing the total amount of charge removed from the charge reservoir associated therewith and the dynodes associated therewith, thereby reducing the time required to recover from saturation.

17. The method of claim 13 comprising configuring said dynodes, said charge reservoirs and said isolating element to allow the electron multiplier to respond essentially linearly to the second of two signal producing events occurring within a short period of time, where in an electron multiplier without the isolating element, the first signal producing event would drive the electron multiplier into saturation causing distortion or missing of the second signal producing event.

18. The method of claim 13 comprising selecting a resistance value for said isolating element that is smaller than the effective resistance of said biasing system.

* * * * *